United States Patent [19]

Reid

[11] Patent Number: 4,647,289

[45] Date of Patent: Mar. 3, 1987

[54] PROCESS AND COMPOSITION FOR COLOR STABILIZED DISTILLATE FUEL OILS

[75] Inventor: Dwight K. Reid, Houston, Tex.

[73] Assignee: Betz Laboratories, Inc., Trevose, Pa.

[21] Appl. No.: 876,324

[22] Filed: Jun. 19, 1986

[51] Int. Cl.[4] ..... C10L 1/22

[52] U.S. Cl. ..... 44/57; 44/63; 44/72

[58] Field of Search ..... 44/57, 72

[56] References Cited

U.S. PATENT DOCUMENTS 2,392,881 1/1946 Rittschof et al. ..... 44/72
3,567,824 3/1971 Moore ..... 44/63
4,440,625 4/1984 Go et al. ..... 44/72
4,456,526 6/1984 Miller et al. ..... 44/72

FOREIGN PATENT DOCUMENTS 2157670 10/1985 United Kingdom .

*Primary Examiner*—Mrs. Y. Harris-Smith
*Attorney, Agent, or Firm*—Alexander D. Ricci; Bruce E. Peacock; James D. Dee

[57] ABSTRACT

This invention relates to processes and compositions for color stabilized distillate fuel oils, such as straight-run diesel fuel, which comprises an effective color stabilizing amount of (a) triethylenetetramine and (b) N,N-diethylhydroxylamine, wherein the weight ratio of (a):(b) is at least about 1.5:3.

13 Claims, No Drawings

PROCESS AND COMPOSITION FOR COLOR STABILIZED DISTILLATE FUEL OILS

BACKGROUND OF THE INVENTION

1. Field of the Invention

This invention relates to color stabilized distillate fuel oils. More particularly, this invention relates to inhibiting color deterioration of distillate fuel oils, such as straight-run diesel fuel.

2. Description of the Prior Art

Various middle distillate fuel oils tend, with time, to deteriorate. Normally, straight-run diesel fuels are stable during standing. However, some straight-run diesel fuels that contain abnormally high levels of organic acid and sulfur containing species can be quite unstable and may deteriorate. This deterioration usually results in the formation of sediment, sludge, or gum and objectionable color deterioration during transportation and storage. This fuel oil deterioration is caused, in part, by the presence of oxygen in the storage tank containing the fuel oil. Resulting oxidation of the fuel oil manifests itself in the appearance of darker colors, gum and the like. Discoloration of distillate fuel oils is objectionable for various reasons, including customers' preference for light colored fuel oils because discoloration may indicate that deterioration has occurred.

Suggestions of the prior art for stabilizing fuel oils include U.S. Pat. No. 2,672,408, Bonner, which discloses the use of oil-soluble water-insoluble amines, the general formula of which can be represented as: $N(R)_3$, wherein R can be hydrogen or the same or different hydrocarbon radicals with at least one R being a non-aromatic hydrocarbon radical, for protection of particular blends of liquid hydrocarbons against discoloration. Also, U.S. Pat. No. 2,742,349, McCoy, discloses the use of arylamine antioxidants and sundry substances derived from the class of piperazines for protecting various organic materials from deterioration in the presence of oxygen. U.S. Pat. No. 2,945,749, Andress, discloses the use of a tertiary alkyl, primary, monoamine having from about 4 to 24 carbon atoms and in which the primary nitrogen atom is directly attached to a tertiary carbon atom, for inhibiting fuel oil deterioration in storage. U.S. Pat. No. 3,017,258, Pollitzer, teaches the use of the reaction product of an amine compound, having at least 12 carbon atoms and a straight chain of at least three carbon atoms attached to the nitrogen atom, with an epihalohydrin compound for retarding deterioration of burner oil. U.S. Pat. No. 3,049,414, Kruyff, discloses a process for stabilizing the color of gasoline comprising the steps of washing the gasoline with a liquid characterized as being free of heavy metals and capable of dissolving pyridine; washing with alkaline aqueous solution, characterized as being free of heavy metals; removing substantially all the free alkali; and then adding an organic nitrogenous base, all of whose carbon-carbon bonds are saturated. U.S. Pat. No. 3,129,699, teaches the use of heterocyclic polyamine salts of organic acids to improve the ignition characteristics of diesel fuel. Also, U.S. Pat. No. 3,198,730, Goodrich, discloses the use of a solid sulfuric acid catalyst composition for treatment of catalytically cracked hydrocarbon distillates boiling up to and including the gas oil boiling range.

Additionally, U.S. Pat. No. 3,490,882, Dunworth, relates to stabilized petroleum distillate fuel oils containing N,N-dimethylcyclohexylamine and, optionally, an N,N'-di(orthohydroxyarylidene)-1,2 -alkylenediamine. U.S. Pat No. 3,640,692, Rakow, et. al., discloses a stabilized distillate hydrocarbon fuel oil composition comprising a major proportion of a distillate hydrocarbon fuel and a minor proportion of a stabilizer comprising (a) an additive selected from the group consisting of (1) an amide plus a Schiff base; (2) an amide containing a Schiff base group; and (3) an amide containing a Schiff base group in combination with either an amide or a Schiff base; and (b) a cyclohexylamine selected from the group consisting of N,N-dimethylcyclohexylamine and dicyclohexylamine. Also, U.S. Pat. No. 3,701,641, discloses a stabilized distillate hydrocarbon fuel oil composition comprising a major proportion of a distillate hydrocarbon fuel and a minor proportion of a stabilizing additive comprised of (a) a polyamine having 2 to about 6 amino groups and containing about 24 to 50 carbons; (b) N,N'-disalicylidine-1,2-propylenediamine, and (c) a cyclohexylamine selected from the group consisting of N,N-dimethylcyclohexylamine and dicyclohexylamine. Of particular interest is U.S. Pat. No. 3,818,006, Klemchuk, which discloses the use of sundry substituted hydroxylamines for stabilizing diverse organic materials against oxidation. Additionally, U.S. Pat. No. 4,509,952, relates to an alkyldimethylamine ranging from $C_4$–$C_{20}$ alkyl which may be added to a distillate fuel as a stabilizer to prevent fuel oil degradation. However, none of these prior art references disclose the unique and effective mixture of triethylenetetramine and N,N-diethylhydroxylamine for inhibiting color deterioration of distillate fuel oils.

SUMMARY OF THE INVENTION

This invention relates to processes for inhibiting color deterioration of distillate fuel oil which comprises adding to the distillate fuel oil an effective inhibiting amount of a mixture of (a) triethylenetetramine and (b) N,N-diethylhydroxylamine, wherein the weight ratio of (a):(b) is at least about 1.5:3. This invention also relates to color stabilized distillate fuel oil compositions comprising distillate fuel oil and an effective color stabilizing amount of (a) triethylenetetramine and (b) N,N-diethylhydroxylamine, wherein the weight ratio of (a):(b) is at least about 1.5:3. Generally, the total amount of the mixture of (a) and (b) is from about 1.0 part to about 10,000 parts per million parts of the fuel oil. It is preferred that the weight ratio of (a):(b) is from about 1.5:3 to about 1:4. This mixture of (a) and (b) provides an L unexpectedly higher degree of color stabilization of distillate fuel oils than the individual ingredients comprising the mixture. It is therefore possible to produce a more effective color stabilized composition and process than is obtainable by the use of each ingredient alone. Because of the enhanced color stabilizing activity of the mixture, the concentrations of each of the ingredients may be lowered and the total amount of (a) and (b) required for an effective color stabilizing treatment may be reduced.

Accordingly, it is an object of the present invention to provide processes and compositions for color stabilizing distillate fuel oils. It is a further object of this invention to inhibit color deterioration of distillate fuel oils. These and other objects and advantages of the present invention will be apparent to those skilled in the art upon reference to the following description of the preferred embodiments.

DESCRIPTION OF THE PREFERRED EMBODIMENTS

The present invention pertains to a process for inhibiting color deterioration of distillate fuel oil, such as straight-run diesel fuel, which comprises adding to the distillate fuel oil an effective inhibiting amount of a mixture of (a) triethylenetetramine and (b) N,N-diethylhydroxylamine, wherein the weight ratio of (a):(b) is at least about 1.5:3. The amounts or concentrations of these two components of this invention can vary depending on, among other things, the tendency of the distillate fuel oil to undergo color deterioration. While from the disclosure of this invention it would be within the capability of those skilled in the art to find by simple experimentation the optimum amounts or concentrations of (a) and (b) for any particular distillate fuel oil, generally the total amount of the mixture of (a) and (b) which is added to the distillate fuel oil is from about 1.0 part to about 10,000 parts per million parts of the distillate fuel oil. Preferably, the mixture of (a) and (b) is added in an amount from about 1.0 part to about 1,500 parts per million. It is also preferred that the weight ratio of (a):(b) is from about 1.5:3 to about 1:4 based on the total combined weight of these two components. Most preferably, the weight ratio of (a):(b) is about 1.5:3 based on the total combined weight ratio of these two components.

The aforementioned two components, triethylenetetramine and N,N-diethylhydroxylamine, are individually presently available commercially. The components can be added to the distillate fuel oil by any conventional method. The two components can be added to the distillate fuel oil as a single mixture containing both compounds or the individual components can be added separately or in any other desired combination. The mixture may be added either as a concentrate or as a solution using a suitable carrier solvent which is compatible with the components and distillate fuel oil. The mixture can also be added at ambient temperature and pressure to color stabilize the distillate fuel oil during storage.

The present invention also pertains to a color stabilized distillate fuel oil composition comprising a major portion of distillate fuel oil, such as straight-run diesel fuel, and a minor portion of an effective color stabilizing amount of (a) triethylenetetramine and (b) N,N-diethylhydroxylamine, wherein the weight ratio of (a):(b) is at least about 1.5:3. Generally, the total amount of (a) and (b) is from about 1.0 part to about 10,000 parts per million parts of the distillate fuel oil and, preferably, the total amount of (a) and (b) is from about 1.0 part to about 1,500 parts per million parts of the distillate fuel oil. It is also preferred that the weight ratio of (a):(b) is from about 1.5:3 to about 1:4 based on the total combined weight of these two components and, most preferably, the weight ratio of (a):(b) is about 1.5:3 based on the total combined weight of these two components.

The distillate fuel oils of this invention are those fuels produced by distillation of fuel oils, such as straight-run diesel fuel, as distinguished from fuel products produced by cracking or reforming processes. More particularly, the distillate fuel oils of this invention are those fuel oils having hydrocarbon components distilling from about 300° F. to about 700° F., such as kerosene, jet fuel and diesel fuel. Preferably, the distillate fuel oil is straight-run diesel fuel.

The processes and compositions of the instant invention effectively color stabilize the distillate fuel oils, particularly during storage. The term "color stabilize" as used herein means that color deterioration of the distillate fuel oil is inhibited. In order to more clearly illustrate this invention, the data set forth below was developed. The following examples are included as being illustrations of the invention and should not be construed as limiting the scope thereof.

EXAMPLES

There are several accelerated test methods that are used by refineries for determining the stability of diesel fuels. Some of the most widely accepted test methods are the 110° F. dark storage test (one week to three months), DuPont F21-61, UOP test method 413, 80° C. test, and the 216° F. test. It was observed that some diesel fuels respond positively to selected chemical additives under specific conditions. In some cases, additives that were effective under accelerated test conditions (e.g., 216° F., 300° F.), were occasionally found to perform poorly under the more moderate 110° F. test. This observation agrees with those found in the recent literature. See Stavinoha, L. L., et. al., "*Accelerated Stability Test Techniques for Diesel Fuels,*" October, 1980. Stability data obtained using the 216° F. or 300° F. accelerated tests are considered to be only qualitative indicators of the performance expectations of an additive under the highly regarded 110° F. storage test condition. It is widely accepted among researchers that seven days at 110° F. is equivalent to one month's storage at 72° F. Although the results of the 110° F. dark storage test are generally accepted as the only valid data in correlating data from these conditions to those from actual storage, some current manufacturers continue to rely on stability data from the more accelerated conditions.

The effect of the components to inhibit color deterioration of a straight-run diesel fuel derived from 50% San Joaquin Valley crude and 50% North Alaska crude was tested using the 216° F. accelerated test method. Four-ounce glass bottles were filled with 100 mLs of the diesel fuel. The samples were then spiked with the appropriate treatments. The glass bottles were capped but not tightly sealed to allow for the samples to be exposed to air during the test. The bottles were then transferred to an oil bath whose temperature was maintained at 216° F.±2° F. during the duration of the test. The oil temperature recovered to 216°±2° F. within 15 minutes after the samples were placed in oil. The bath oil level covered at least three-fourths of the sample. The test was allowed to run for the time periods specified below. The samples were then removed and stored in the dark for two hours. The color of the samples was determined by visual comparison with known standards according to the ASTM-D-1500 procedure, which involved matching the color of the fuel samples with ASTM-1500 color numbers. The results are based on a scale of 0.5 to 8.0 wherein increasing values indicate increasing darkness of the sample. The results obtained are reported in Table I below.

TABLE I

| | TETA[1] | DEHA[2] | ASTM COLOR # a | ASTM COLOR # b |
|---|---|---|---|---|
| CONC. | — | — | 3.4[3] | 3.8[3] |
| ACTIVE | 250 | 250 | 1.5 | 1.8 |

TABLE I-continued

| | TETA[1] | DEHA[2] | ASTM COLOR # a | ASTM COLOR # b |
|---|---|---|---|---|
| PPM | 125 | 125 | 2.0 | 2.5 |

ASTM Color:
a 2½ hours at 216° F.
b 2½ hours at 216° F. plus 24 hours at 72° F.
[1]Triethylenetetramine
[2]N,N—diethylhydroxylamine
[3]Control - untreated sample The results reported in Table I indicate that the combination of the components of this invention, triethylenetetramine (TETA) and N,N-diethylhydroxylamine (DEHA), is effective in inhibiting color deterioration of the straight-run diesel fuel.

Additional tests were conducted to determine the effect of the components and their concentration to inhibit color deterioration of a straight-run diesel fuel derived from 50% San Joaquin Valley crude and 50% North Alaska crude using the 110° F. dark storage test. 100 mLs of the diesel fuel were transferred into glass bottles. Caps were secured on the bottled samples but not tightly in order to expose the fuel to atmospheric conditions. The samples were placed in an oven set at 110° F. for 14 days. The samples were then removed from the oven and allowed to cool to room temperature. After each sample had cooled, it was poured into a separatory funnel and filtered (dispersed) through a tared Gooch crucible containing two glass-fiber filter papers. The ASTM-D-1500 procedure was used to determine the color of the filtrant. The results obtained are reported in Table II below.

TABLE II

| Concentration Level of Active Agent (ppm) TETA[1] | DEHA[2] | Other | Color Level of Diesel Fuel[3] ASTM Color Number |
|---|---|---|---|
| — | — | Blank | 6.0 |
| — | — | Blank | 6.0 |
| — | — | Blank[4] | 6.0 |
| 150 | — | — | 6.0 |
| 150 | — | (5) | 6.0 |
| — | 150 | — | 4.3 |
| — | 300 | — | 4.3 |
| 150 | 150 | — | 4.5 |
| 150 | 300 | — | 2.8 |

[1]Triethylenetetramine
[2]N,N—diethylhydroxylamine
[3]Determined after 14 days at 110° F. in an ambient atmosphere.
[4]Sample exposed to air after 1, 7 and 14 days; after each exposure, filtrations were performed. These filtrations yielded a combined weight of precipitate.
[5]A second sample was prepared and examined after 13 days of heated storage.

The results reported in Table II demonstrate the unique and exceptionally effective relationship of the components of this invention since the sample containing triethylenetetramine (TETA) and N,N-diethylhydroxylamine (DEHA) wherein the weight ratio of TETA:DEHA was 1.5:3 shows superior effectiveness in inhibiting color deterioration of the diesel fuel than was obtainable in using each of the components individually.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for inhibiting color deterioration of distillate fuel oil which comprises adding to said fuel oil an effective inhibiting amount of a mixture of (a) triethylenetetramine and (b) N,N-diethylhydroxylamine, wherein the weight ratio of (a):(b) is at least about 1.5:3.

2. The process of claim 1 wherein said mixture is added in an amount from about 1.0 part to about 10,000 parts per million parts of said fuel oil.

3. The process of claim 1 wherein said mixture is added at ambient temperature and pressure.

4. The process of claim 1 wherein the weight ratio of (a):(b) is from about 1.5:3 to about 1:4.

5. The process of claim 4 wherein the distillate fuel oil is straight-run diesel fuel.

6. The process of claim 5 wherein the weight ratio of (a):(b) is F about 1.5:3.

7. The process of claim 5 or 6 wherein said mixture is added in an amount from about 1.0 part to about 1,500 parts per million parts of said diesel fuel.

8. A color stabilized distillate fuel oil composition comprising distillate fuel oil and an effective color stabilizing amount of (a) triethylenetetramine and (b) N,N-diethylhydroxylamine, wherein the weight ratio of (a):(b) is at least about 1.5:3.

9. The composition of claim 8 wherein the total amount of (a) and (b) is from about 1.0 part to about 10,000 parts per million parts of said fuel oil.

10. The composition of claim 8 wherein the weight ratio of (a):(b) is from about 1.5:3 to about 1:4.

11. The composition of claim 10 wherein the distillate fuel oil is straight-run diesel fuel.

12. The composition of claim 11 wherein the weight ratio of (a):(b) is about 1.5:3.

13. The composition of claim 11 or 12 wherein the total amount of (a) and (b) is from about 1.0 part to about 1,500 parts per million parts of said diesel fuel.

* * * * *